US011768009B2

(12) United States Patent
Richard

(10) Patent No.: US 11,768,009 B2
(45) Date of Patent: Sep. 26, 2023

(54) HVAC DUCT CONNECTION SYSTEM AND FLANGE

(71) Applicant: AR Developing, LLC, Chaplin, CT (US)

(72) Inventor: Alain Richard, Chaplin, CT (US)

( * ) Notice: Subject to any disclaimer, the term of this patent is extended or adjusted under 35 U.S.C. 154(b) by 250 days.

(21) Appl. No.: 17/112,109

(22) Filed: Dec. 4, 2020

(65) Prior Publication Data

US 2021/0172643 A1 Jun. 10, 2021

Related U.S. Application Data

(60) Provisional application No. 62/972,951, filed on Feb. 11, 2020, provisional application No. 62/949,753, filed on Dec. 18, 2019, provisional application No. 62/944,081, filed on Dec. 5, 2019.

(51) Int. Cl.
*F24F 13/02* (2006.01)

(52) U.S. Cl.
CPC ..... *F24F 13/0209* (2013.01)

(58) Field of Classification Search
CPC ..... F16L 23/14; F16L 23/036; F16L 23/02; F24F 13/0209
See application file for complete search history.

(56) References Cited

U.S. PATENT DOCUMENTS 2,321,378 A 6/1943 Green
2,321,379 A 6/1943 Green
3,108,371 A * 10/1963 Munse ..... B21D 53/24 72/356
3,118,718 A 1/1964 Babey
3,524,378 A 8/1970 Wieber
(Continued)

FOREIGN PATENT DOCUMENTS

DE 4224257 C2 5/1995
DE 10047727 C2 9/2003
(Continued)

OTHER PUBLICATIONS

GlobalMarket, "Duct Corner, TDC duct corner, TDF corner", http://www.globalmarket.com/product-info/duct-corner-tdc-duct-corner-tdf-corner-2562700.html, accessed Dec. 3, 2020.
(Continued)

*Primary Examiner* — Matthew Troutman
*Assistant Examiner* — Alexander T Rufrano
(74) *Attorney, Agent, or Firm* — Getz Balich LLC

(57) ABSTRACT

An HVAC duct section connection system is provided with first and second corner flanges, and at least one self-threading bolt. Both the first corner flange and the second corner flange include first and second legs. The first and second legs having an interior surface and an exterior surface. The exterior surface is disposed opposite the interior surface. The first and second corner flanges each have at least one fastener aperture extending between the interior and the exterior surfaces, the fastener aperture including an integrally formed truncated cone extending out from the exterior surface, wherein the truncated cone has an inner diameter. The self-threading bolt has a shank and a head, the shank having a threaded section with a thread diameter sized to engage the inner diameter of the truncated cone.

1 Claim, 8 Drawing Sheets

(56) References Cited

U.S. PATENT DOCUMENTS

| | | | | |
|---|---|---|---|---|
| 3,877,327 | A | 4/1975 | Erm | |
| 3,911,736 | A | 10/1975 | Miller | |
| 4,123,094 | A | 10/1978 | Smitka | |
| 4,185,487 | A | 1/1980 | Merideth | |
| 4,218,079 | A | 8/1980 | Arnoldt | |
| 4,244,609 | A | 1/1981 | Smitka | |
| 4,410,206 | A | 10/1983 | Mez | |
| 4,425,066 | A | 1/1984 | Kollmann | |
| 4,466,641 | A | 8/1984 | Heilman | |
| 4,508,376 | A | 4/1985 | Arnoldt | |
| 4,537,430 | A | 8/1985 | Sullivan | |
| 4,572,553 | A | 2/1986 | Geldner | |
| 4,579,375 | A | 4/1986 | Fischer | |
| 4,662,661 | A | 5/1987 | Arnoldt | |
| 4,781,503 | A | 11/1988 | Bogel | |
| 4,834,603 | A * | 5/1989 | Holton | B21D 22/04 411/521 |
| 5,022,688 | A | 6/1991 | Arnoldt | |
| 5,069,484 | A | 12/1991 | McElroy | |
| 5,163,311 | A | 11/1992 | McClain | |
| 5,165,730 | A * | 11/1992 | McElroy | F16L 23/14 285/39 |
| 5,283,944 | A | 2/1994 | Goodhue | |
| 5,321,880 | A | 6/1994 | Goodhue | |
| 5,342,100 | A | 8/1994 | Goodhue | |
| 5,342,150 | A | 8/1994 | Kitchen | |
| 5,353,616 | A | 10/1994 | Fischer | |
| 5,462,089 | A | 10/1995 | McClain | |
| 5,564,758 | A | 10/1996 | Tiberio | |
| 5,653,482 | A | 8/1997 | Ficchi, Jr. | |
| 5,836,731 | A | 11/1998 | Goodwin | |
| 36,797 | A | 8/2000 | Eggert | |
| 6,164,887 | A | 12/2000 | Palm | |
| 6,412,519 | B1 | 7/2002 | Goodhue | |
| 6,428,056 | B1 | 8/2002 | Issagholian-Havai | |
| 6,460,573 | B1 | 10/2002 | Fischer | |
| 6,471,256 | B1 | 10/2002 | Fischer | |
| 6,502,716 | B1 | 1/2003 | Kolesar | |
| 6,547,287 | B1 | 4/2003 | Shah | |
| 6,810,570 | B2 | 11/2004 | Fischer | |
| 6,994,502 | B2 | 2/2006 | Winter | |
| 7,029,037 | B2 | 4/2006 | Poole | |
| 7,131,796 | B2 | 11/2006 | Rooney | |
| 7,163,030 | B2 | 1/2007 | Hermanson | |
| 7,744,134 | B2 * | 6/2010 | Dingley | F24F 13/0209 285/48 |
| 8,057,147 | B2 | 11/2011 | Ernst | |
| 8,172,280 | B2 * | 5/2012 | Fischer | F24F 13/0209 285/424 |
| 8,262,330 | B2 * | 9/2012 | Ishino | B41J 29/02 411/58 |
| 8,474,881 | B2 | 7/2013 | Fischer | |
| 8,931,163 | B2 | 1/2015 | Kochheiser | |
| 9,194,411 | B2 | 11/2015 | Carson | |
| 9,347,476 | B2 | 5/2016 | Carson | |
| 10,240,626 | B2 | 3/2019 | Mair | |
| 10,544,891 | B2 * | 1/2020 | Fischer | F16L 23/14 |
| 10,578,333 | B2 | 3/2020 | Yoskowitz | |
| 2002/0124614 | A1 | 9/2002 | Hermanson | |
| 2003/0223842 | A1 | 12/2003 | Shinjo | |
| 2007/0269288 | A1 | 11/2007 | Palm | |
| 2008/0005994 | A1 | 1/2008 | Harney | |
| 2009/0224538 | A1 | 9/2009 | Fischer | |
| 2011/0215538 | A1 | 9/2011 | Cornwell | |
| 2012/0248768 | A1 | 10/2012 | Fischer | |
| 2012/0266995 | A1 | 10/2012 | Carson | |
| 2016/0327081 | A1 | 11/2016 | Mair | |
| 2018/0224031 | A1 | 8/2018 | Fischer | |
| 2018/0231160 | A1 | 8/2018 | Fischer | |

FOREIGN PATENT DOCUMENTS

| | | | |
|---|---|---|---|
| FR | 2631275 | A1 | 11/1989 |
| JP | H0667988 | U * | 9/1994 |
| JP | 2010051708 | A | 3/2010 |

OTHER PUBLICATIONS machines4u.com.am, the Machinery Marketplace, "HVAC TDF Corner Insert Machine—PLC Controlled—240Volt", https://www.machines4u.com.au/view/advert/HVAC-TDF-Corner-Insert-Machine-PLC-Controlled-240Volt/379839/, accessed Dec. 3, 2020.

PrudentAire, "TDF Corner" https://m.prudentaire.com/?ws=showproducts&products_id=1872448&cat=Duct-Accessories, accessed Dec. 3, 2020.

Jack-Aiva, "Duct Corner Punching Machine TDC/TDF", http://www.ductingmachine.com/html_products/pro-78.html, accessed Dec. 3, 2020.

TradeKorea, "TDC TDF Duct Corner," https://www.tradekorea.com/product/detail/P410974/TDC-TDF-DUCT-CORNER.html, accessed Dec. 3, 2020.

* cited by examiner

HVAC DUCT CONNECTION SYSTEM AND FLANGE

This application claims priority to U.S. Provisional Patent Application No. 62/944,081 filed Dec. 5, 2019, and to U.S. Patent Provisional Patent Application No. 62/949,753 filed Dec. 18, 2019, and to U.S. Patent Provisional Patent Application No. 62/972,951 filed Feb. 11, 2020 all of which are herein incorporated by reference in their entirety.

BACKGROUND OF THE INVENTION

1. Technical Field

The present application relates generally to duct joining systems used in heating, ventilating, and air conditioning ("HVAC") systems generally, and to corner flanges utilized to secure duct sections together in particular.

2. Background Information

Forced air HVAC systems often use air ducts as a conduit for transporting pressurized air in buildings. The air ducts are typically formed in duct sections that are subsequently attached to one another to form longer spans as needed. Duct sections are typically made from sheet metal that is formed to have a rectangular shape defined by orthogonal widthwise walls and heightwise walls.

The duct walls of each duct section are also each formed with an end flange that extends outwardly from the respective wall, at each lengthwise end of the duct section. To create an HVAC duct having an extended length, duct sections are positioned lengthwise end-to-end so that the end flanges of one duct section align with the end flanges of an adjacent duct section.

The end flanges typically extend only the length of the respective wall and gaps are created at each of the four corners. A pair of L-shaped corner flanges are typically engaged with the end flanges at each corner; e.g., one corner flange of the pair is engaged with the end flanges of a first duct section, and the other corner flange of the pair is engaged with the end flanges of a second duct section. When the duct sections to be joined are positioned lengthwise end-to-end, the corner flange of one duct section is aligned with the corner flange of the other duct section. Fasteners are then used to attach the aligned corner flanges to one another. This occurs at each of the four corners of the duct sections. Typically, the fasteners used to attach the aligned corner flanges to one another are bolt and nut pairs. Clips or self-tapping screws are typically used to attach the aligned end flange portions disposed widthwise or heightwise between the corner flanges. Gaskets may be disposed between the abutting end flanges to prevent leakage between the connecting end flanges.

Prior art corner flanges suffer from a number of disadvantages. Corner flange configurations that use bolt and nut pairs require the installer to hold one of the bolt or nut while the other of the bolt or nut is tightened. Hence, the operator typically must use both hands. In installations where access to the duct section corners is problematic, the act of holding one of the bolt or nut while tightening the other can be awkward and time-consuming. Some corner flange configurations that use bolt and nut pairs are configured to utilize a carriage bolt to avoid the need to hold the bolt head; e.g., the corner flange includes a square aperture to receive the square collar portion of the carriage bolt head. The threaded portion of the carriage bolt extends through the same square aperture of the opposing corner flange to receive the nut. The square aperture configured to receive the square collar portion of the carriage bolt head avoids the need to use a tool to hold the bolt, but the carriage bolt must initially be held in place (i.e., square collar held engaged with square aperture) and the nut must be threaded onto the carriage bolt. Hence, although the carriage bolt obviates the need for two tools, the installer must still use two hands during the initial installation.

What is needed is a corner flange that overcomes the disadvantages of the prior art corner flanges.

SUMMARY

According to an aspect of the present disclosure, an HVAC duct section connection system is provided that includes a first corner flange, a second corner flange, and at least one self-threading bolt. The first corner flange and the second corner flange each include a first leg, a second leg, an interior surface, an exterior surface, and at least one fastener aperture. The first and second legs are integrally connected to one another at a respective first end, and each leg extending outwardly away from the respective first end away from the other leg. The interior surface and the exterior surface extend along the first and second legs, and the exterior surface is disposed opposite the interior surface. The at least one fastener aperture extends between the interior surface and the exterior surface. The fastener aperture includes an integrally formed truncated cone extending out from the exterior surface. The truncated cone has an inner diameter. The self-threading bolt has a shank and a head, the shank having a threaded section with a thread diameter sized to engage the inner diameter of the truncated cone.

In any of the aspects or embodiments described above and herein, the truncated cones of the first corner flange and the second corner flange may include plastically deformed material.

In any of the aspects or embodiments described above and herein, the truncated cone may include at least one slit.

In any of the aspects or embodiments described above and herein, the truncated cone may include a plurality of slits and a plurality of cone sections, wherein adjacent cone sections are separated from one another by a one of said plurality of slits.

In any of the aspects or embodiments described above and herein, the truncated cone may include at least one wall failure element.

In any of the aspects or embodiments described above and herein, the truncated cone may include an inner diameter surface, and the at least one wall failure element may be disposed in the inner diameter surface.

In any of the aspects or embodiments described above and herein, the truncated cone may include an outer diameter surface, and the at least one wall failure element may be disposed in the inner outer surface.

In any of the aspects or embodiments described above and herein, the truncated cone may include an inner diameter surface and an outer diameter surface, and the at least one wall failure element may be a plurality of wall failure elements, and at least one of the wall failure elements may be disposed in the inner diameter surface, and at least one of the wall failure elements may be disposed in the outer diameter surface.

In any of the aspects or embodiments described above and herein, the shank of the at least one self-threading bolt may include a threaded portion having a first diameter and an unthreaded section having a second diameter, the second diameter is less than the first diameter. The unthreaded section may be disposed between the threaded section and the head, and the first diameter sized so that the threaded portion threadably engages the inner diameter of the truncated cone.

In any of the aspects or embodiments described above and herein, the integrally formed truncated cone may have an engagement length that is at least long enough to have two circumferential threads of the threaded section engaged with the truncated cone.

According to another aspect of the present disclosure, a method of joining together duct sections of an HVAC duct is provided. Each duct section includes a plurality of end flanges. The method includes: a) providing a first corner flange and a second corner flange, the first corner flange including: a first leg and a second leg, the first and second legs integrally connected to one another at a respective first end, and each leg extending outwardly away from the respective first end away from the other leg; an interior surface extending along the first and second legs; an exterior surface extending along the first and second legs, the exterior surface disposed opposite the interior surface; and at least one fastener aperture extending between the interior surface and the exterior surface, the fastener aperture including an integrally formed truncated cone extending out from the exterior surface, wherein the truncated cone has an inner diameter; b) providing at least one self-threading bolt having a shank and a head, the shank having a threaded section with a thread diameter sized to engage the inner diameter of the truncated cone; c) disposing the first corner flange in contact with a first pair of end flanges of a first duct section; d) disposing the second corner flange in contact with a second pair of end flanges of a second duct section; and e) joining the first and second duct sections together, the joining including passing a one of the at least one self-threading bolt through an aperture in the second corner flange, and threadably engaging the one of the at least one self-threading bolt with the truncated cone of the first corner flange until the first pair of end flanges and the second pair of end flanges are in contact with one another.

In any of the aspects or embodiments described above and herein, the second corner flange may be configured the same as the first corner flange.

In any of the aspects or embodiments described above and herein, the shank of the at least one self-threading bolt may include a threaded portion having a first diameter and an unthreaded section having a second diameter, the second diameter is less than the first diameter, the unthreaded section disposed between the threaded section and the head, the first diameter sized so that the threaded portion threadably engages the inner diameter of the truncated cone of the first corner flange during the joining step.

In any of the aspects or embodiments described above and herein, the at least one self-threading bolt may be threadably engaged with the truncated cone of the first corner flange until the unthreaded section is disposed within the truncated cone of the second corner flange.

According to another aspect of the present disclosure, a duct corner flange is provided that includes a first leg, a second leg, an interior surface, an exterior surface, and at least one fastener aperture. The first and second legs are integrally connected to one another at a respective first end, and each leg extends outwardly away from the respective first end away from the other leg. The interior and exterior surfaces extend along the first and second legs. The exterior surface is disposed opposite the interior surface. The fastener aperture extends between the interior surface and the exterior surface. The fastener aperture includes an integrally formed truncated cone extending out from the exterior surface. The truncated cone comprises plastically deformed material.

In any of the aspects or embodiments described above and herein, the truncated cone may include at least one slit.

In any of the aspects or embodiments described above and herein, the truncated cone may include a plurality of slits and a plurality of cone sections, wherein adjacent cone sections are separated from one another by a one of said plurality of slits.

In any of the aspects or embodiments described above and herein, the truncated cone may include at least one wall failure element.

In any of the aspects or embodiments described above and herein, the truncated cone may include an inner diameter surface, and the at least one wall failure element may be disposed in the inner diameter surface.

In any of the aspects or embodiments described above and herein, the truncated cone may include an outer diameter surface, and the at least one wall failure element may be disposed in the outer diameter surface.

In any of the aspects or embodiments described above and herein, the truncated cone may include an inner diameter surface and an outer diameter surface, and the at least one wall failure element is a plurality of wall failure elements, and at least one of the wall failure elements is disposed in the inner diameter surface, and at least one of the wall failure elements is disposed in the outer diameter surface.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

DETAILED DESCRIPTION

Figure 1:
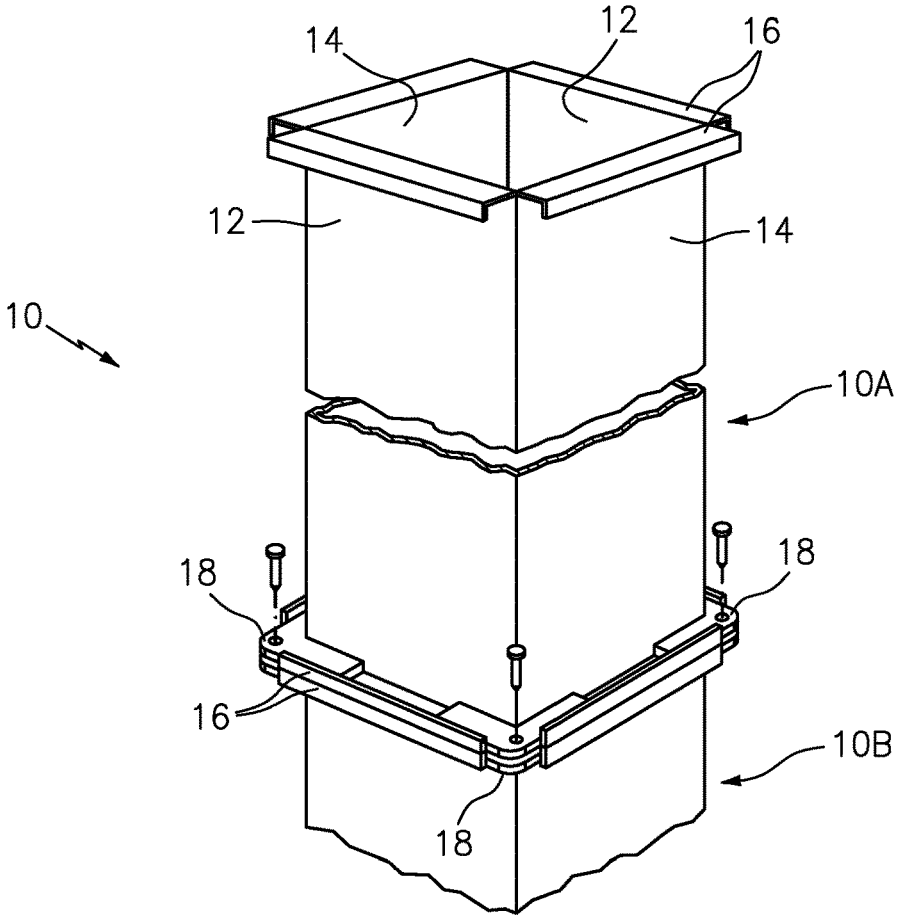
FIG. 1 is a perspective view of duct sections of an HVAC duct joined together at lengthwise ends.
Figure 2:
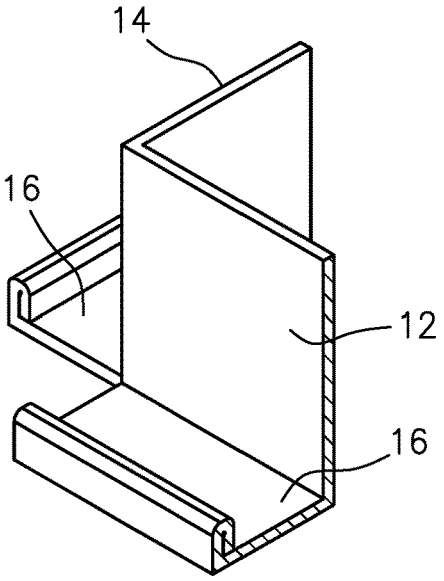
FIG. 2 is a partial view of a duct section corner.
Figure 3:
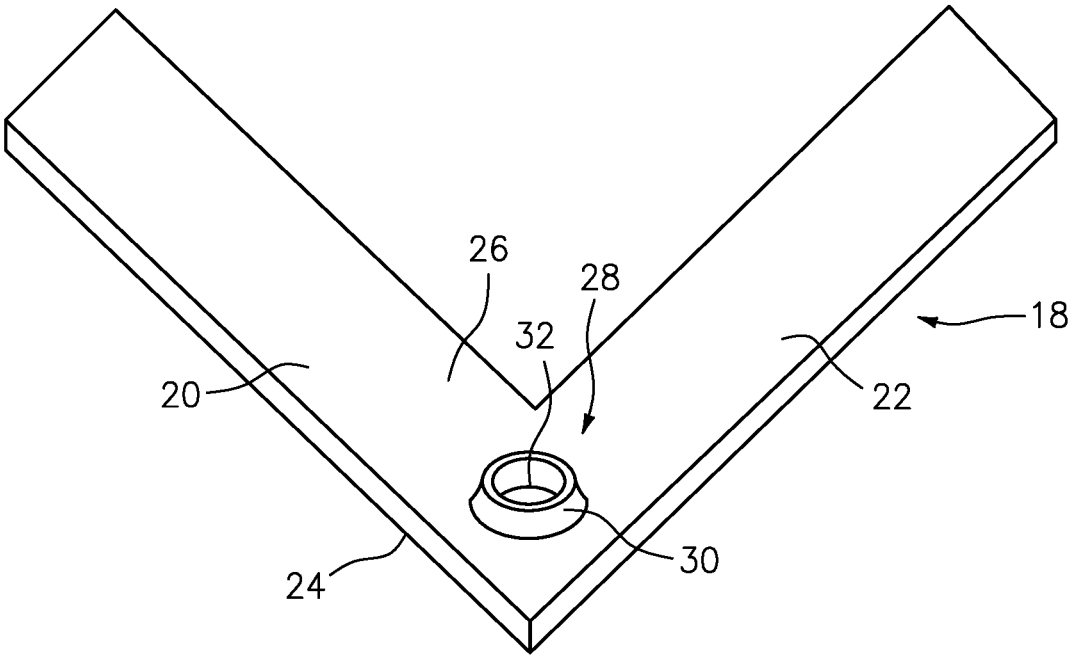
FIG. 3 is a planar view of a present disclosure corner flange embodiment.
Figure 4:
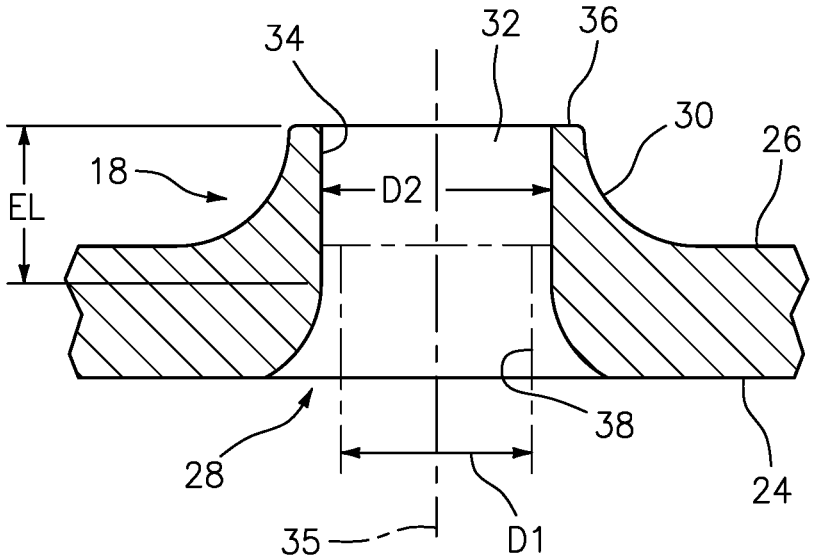
FIG. 4 is a sectional view of a fastener aperture portion of the corner flange embodiment shown in FIG. 3.

Referring to FIGS. 1 and 2, a forced air HVAC system often uses air ducts 10 as a conduit for transporting pressurized air in buildings. The air ducts 10 are typically formed in duct sections 10A, 10B that are subsequently attached to one another to form a longer lengthwise extending span as needed. Duct sections 10A, 10B are typically made from sheet metal that is formed to have a rectangular shape defined by orthogonal widthwise walls 12 and heightwise walls 14. Each wall 12, 14 of the duct section includes an end flange 16. To create an HVAC duct having an extended length, duct sections 10A, 10B are positioned lengthwise end-to-end so that the end flanges 16 of one duct section 10A align with the end flanges 16 of an adjacent duct section 10B.

A corner flange 18 is typically disposed at each corner of a respective duct section 10A, 10B, in contact with the end flanges 16. Very often, the end flanges 16 may be peened over, or crimped, or otherwise bent, to hold the respective corner flange 18 in place relative to the end flange 16. The respective duct sections 10A, 10B may be attached to one another by securing the opposing corner flanges 18 at each corner to one another (e.g., using fasteners).

The present disclosure corner flange 18 embodiments obviate the need to use a bolt and nut pair to attach the opposing corner flanges to one another. Referring to FIGS. 3-6, a corner flange 18 is provided having an "L" shaped body with a first leg 20 and a second leg 22. The first leg 20 and the second leg 22 are joined to one another (e.g., a unitary structure), and extend outwardly from each other in substantially perpendicular directions. The corner flange 18 is typically made from a metallic material; e.g., a mild steel, aluminum, etc. The corner flange 18 includes an interior surface 24 and an opposite exterior surface 26. The corner flange 18 includes at least one fastener aperture 28. The fastener aperture 28 includes a truncated cone 30 of material extending outwardly from the exterior surface 26 of the corner flange 18. The truncated cone 30 has a bore 32 defined by an inner diameter surface 34. The bore 32 extends lengthwise along a central axis 35 from the interior surface 24 of the corner flange 18 to an end surface 36. At least a portion of the truncated cone bore 32 may have a constant diameter.

Figure 11:
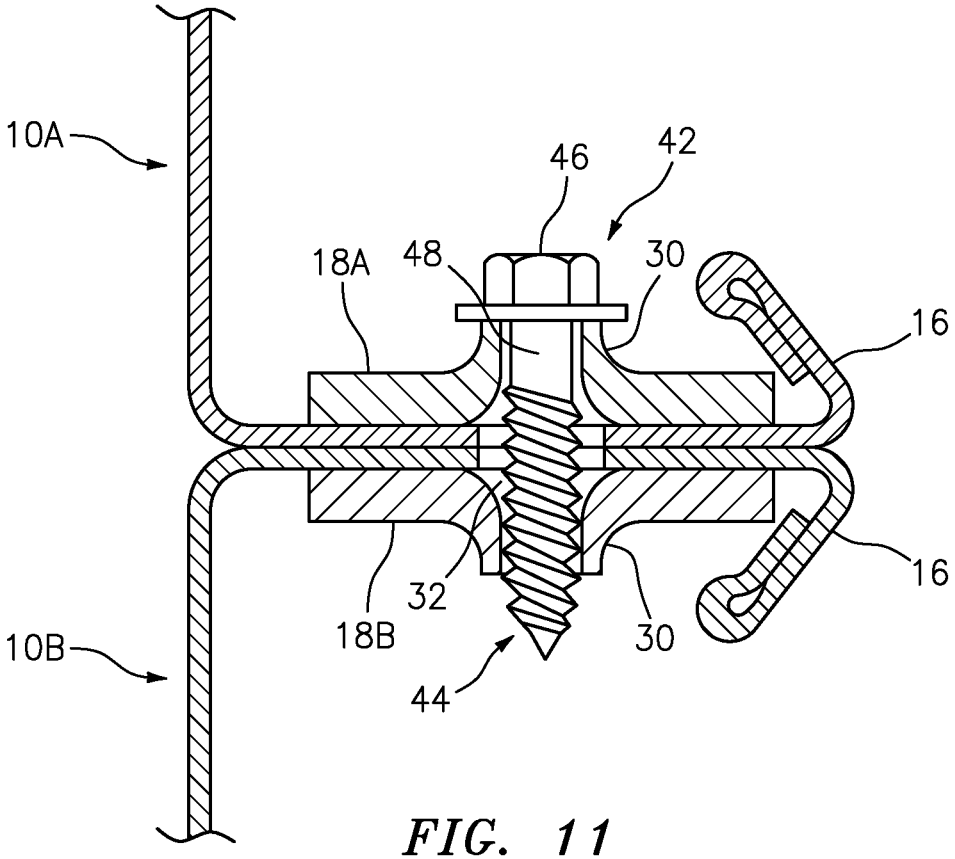
FIG. 11 is a diagrammatic sectional view of duct sections connected by present disclosure corner flange embodiments.

The truncated cone 30 may be formed by a deformation process (e.g., a mechanical punch process) that plastically deforms corner flange body material outwardly to create the aforesaid truncated cone 30. A non-limiting example of how a truncated cone 30 may be formed involves drilling or otherwise forming an initial aperture 38 having a diameter D1 (shown diagrammatically in phantom line in FIG. 5) extending through the corner flange body; e.g., providing a through hole that extends between the interior surface 24 and the exterior surface 26 of the corner flange body. Subsequently, the flange 18 at the initial aperture 38 may be deformed mechanically. For example, a mechanical punch may be used to mechanically deform the aperture 38, which punch is configured to form an aperture portion having an inner diameter D2 (where D2 is greater than diameter D1) while being forced into the aperture 38 from the interior surface 24. The geometry of the punch causes some amount of corner flange body material surrounding the initial aperture 38 to plastically deform and move outwardly from the exterior surface 26 of the corner flange body. The truncated cone bore is sized so that the threads of the self-threading bolt engage with the material of the truncated cone 30 to create a threaded engagement between the truncated cone 30 and the self-threading bolt. In other words, the diameter of the bore 32 created within the truncated cone 30 is chosen relative to the size of a self-threading bolt used to secure the corner flanges 18 together, or vice versa. Preferably, the bore is circular, or at least substantially circular, to ensure substantial circumferential thread engagement with the bolt. In addition, the truncated cone is formed to have a thread engagement length ("EL") that is adequate, in combination with the circumferential thread engagement, to accommodate the amount of force required to hold the corner flanges together under normal operational circumstances. In most HVAC duct applications, the corner flange bolt diameter is three-eighths of an inch (⅜"), and has a course thread (e.g., twelve threads per inch). In such applications, the EL of the truncated cone 30 is preferably long enough to permit circumferential engagement with at least two threads of a bolt (e.g., bolt 42 as shown in FIG. 11). The present disclosure corner flanges are not limited to use with circular bolts, or any particular diameter bolt, or any particular bolt thread configuration.

Figure 5:
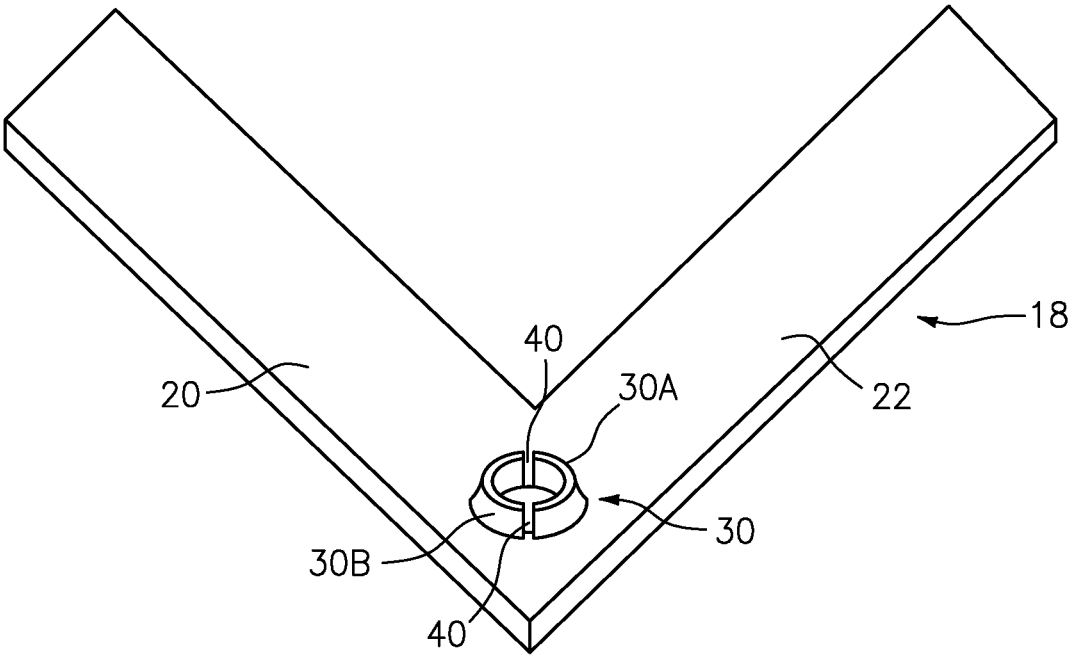
FIG. 5 is a planar view of a present disclosure corner flange embodiment.
Figure 6:
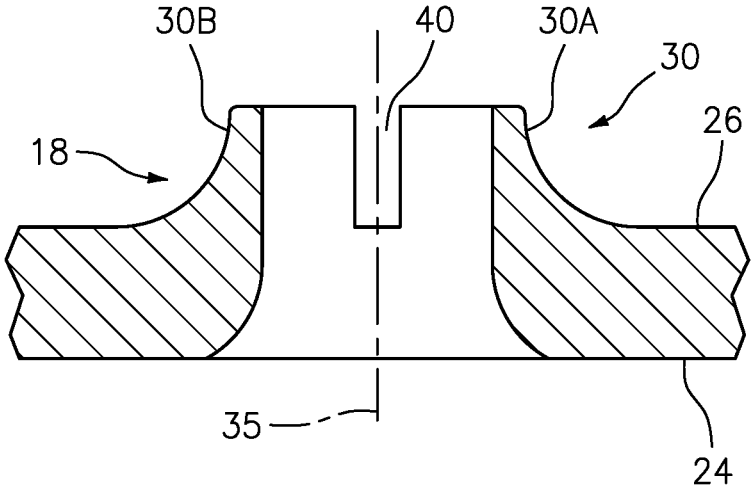
FIG. 6 is a sectional view of a fastener aperture portion of the corner flange embodiment shown in FIG. 5.
Figure 6A:
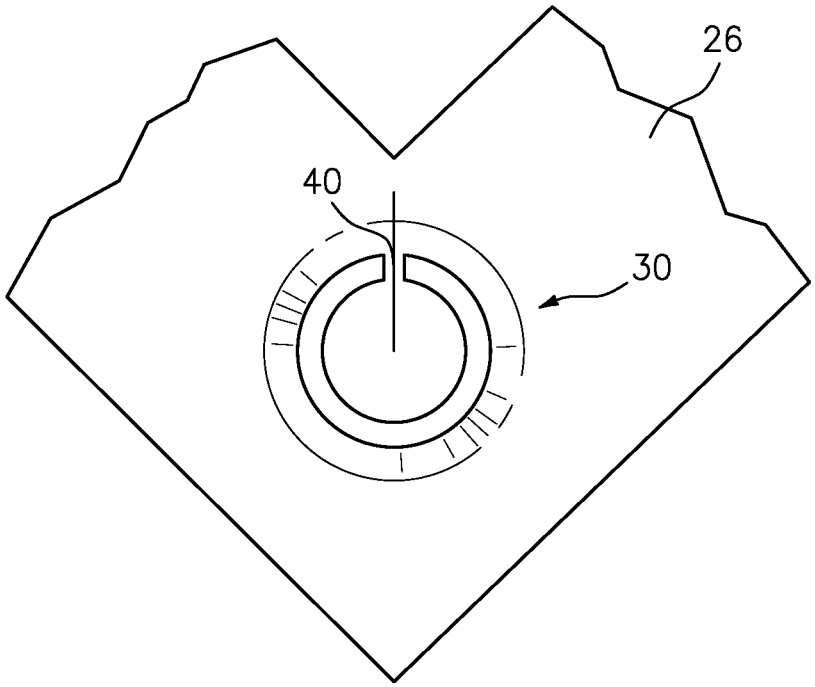
FIG. 6A is a planar view of an embodiment of a fastener aperture portion of a corner flange embodiment.
Figure 6B:
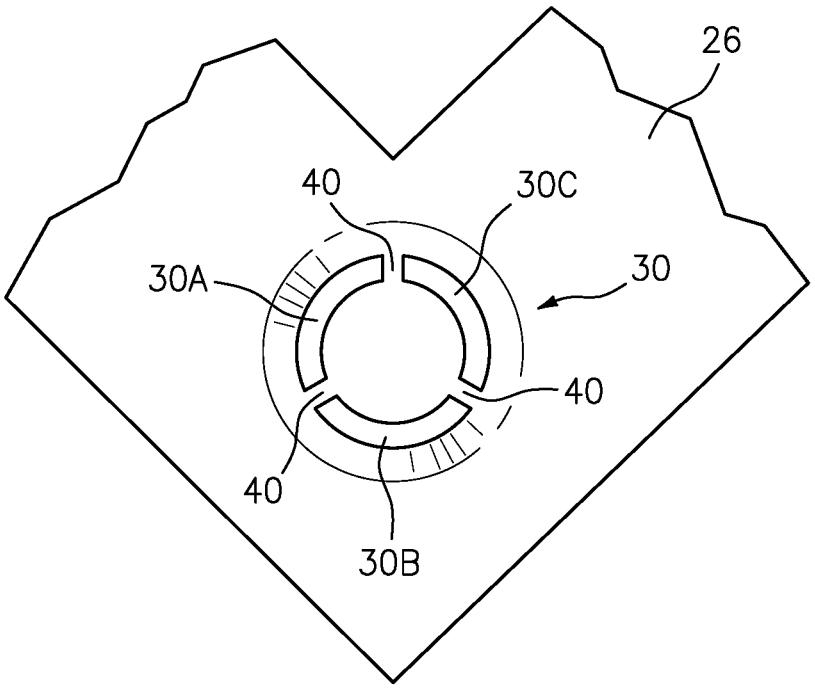
FIG. 6B is a planar view of an embodiment of a fastener aperture portion of a corner flange embodiment.
Figure 6C:
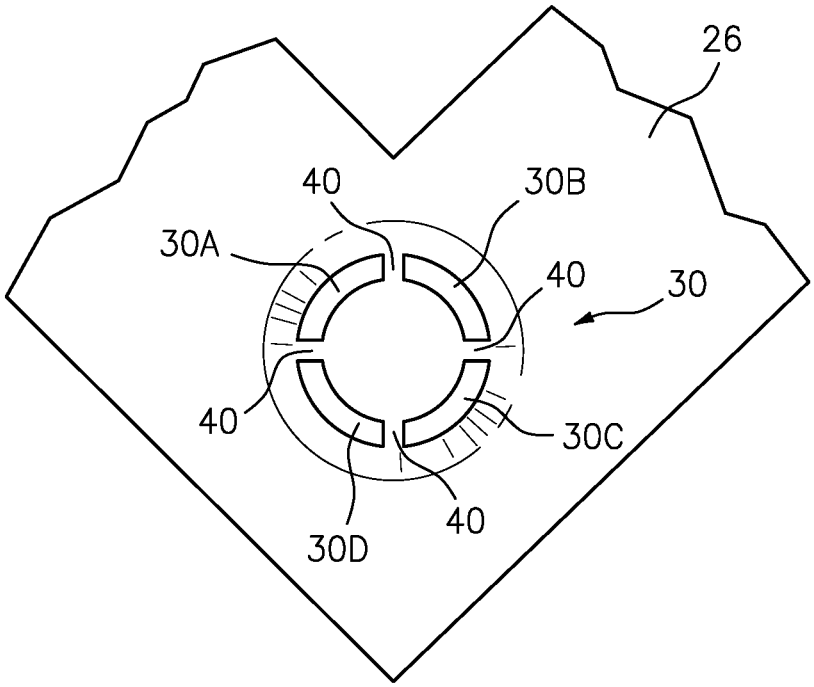
FIG. 6C is a planar view of an embodiment of a fastener aperture portion of a corner flange embodiment.
Figure 7:
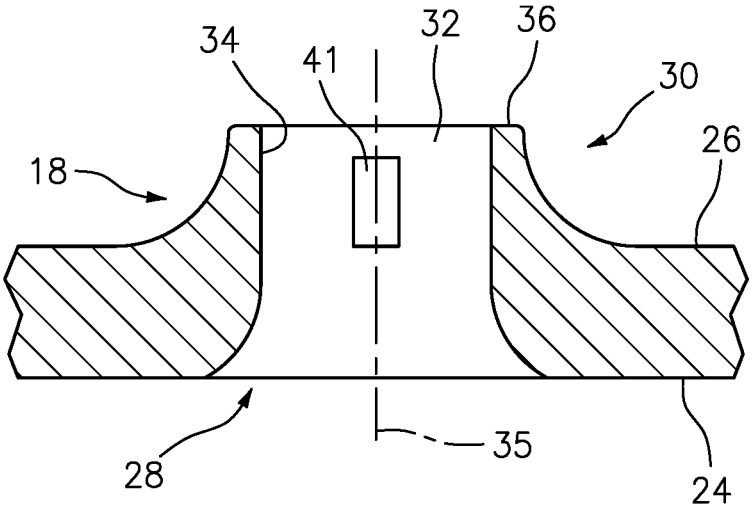
FIG. 7 is a sectional view of a fastener aperture portion of the corner flange embodiment.

In the embodiment shown in FIGS. 5 and 6-6C, the truncated cone 30 includes a plurality of cone sections (i.e., 30A, 30B in FIGS. 5 and 6; 30A, 30B, 30C in FIG. 6B, etc.) separated by one another by voids (each void hereinafter referred to hereinafter as a slit 40); e.g., adjacent cone sections 30A, 30B are separated from one another by a slit 40. The present disclosure is not limited to forming the slits 40 by any particular process. Each cone section 30A, 30B forms a quasi-cantilever element that acts elastically when forced radially outwardly (e.g., when a bolt is threaded into the aperture), producing a radially inward biasing force. The exemplary embodiment shown in FIGS. 5 and 6 shows two cone sections 30A, 30B. The exemplary embodiment shown in FIG. 6A illustrates a truncated cone 30 that includes a single slit 40. The exemplary embodiment shown in FIG. 6B shows three slits 40, and three cone sections 30A, 30B, 30C. The exemplary embodiment shown in FIG. 6C shows four slits 40, and four cone sections 30A, 30B, 30C, 30D. The present disclosure is not limited to any particular number of number of slits 40/cone sections. In the embodiment shown in FIG. 7, the truncated cone 30 includes one or more apertures 41. In contrast to a slit 40, an aperture 41 disposed within the wall(s) that forms the truncated cone 30 does not break through the end surface 36 of the truncated cone 30. The aperture 41 shown in FIG. 7 may be referred to as a slot, having a greater length (extending along a major axis) than a width (extending along a minor axis). The present disclosure is not limited to any particular aperture configuration; e.g., slots, circular, oval, etc. The present disclosure is not limited to any particular orientation of the aperture 41 within the wall of the truncated cone 30. For example, if the aperture 41 is asymmetric (i.e., has a major axis longer than a minor axis), the major axis may be aligned with the central axis 35 of the aperture 28, or the major axis may be perpendicular to the central axis 35 of the aperture 28, or the major axis may be skewed at a non-perpendicular angle to the central axis of the aperture 28, etc.

Figure 8:
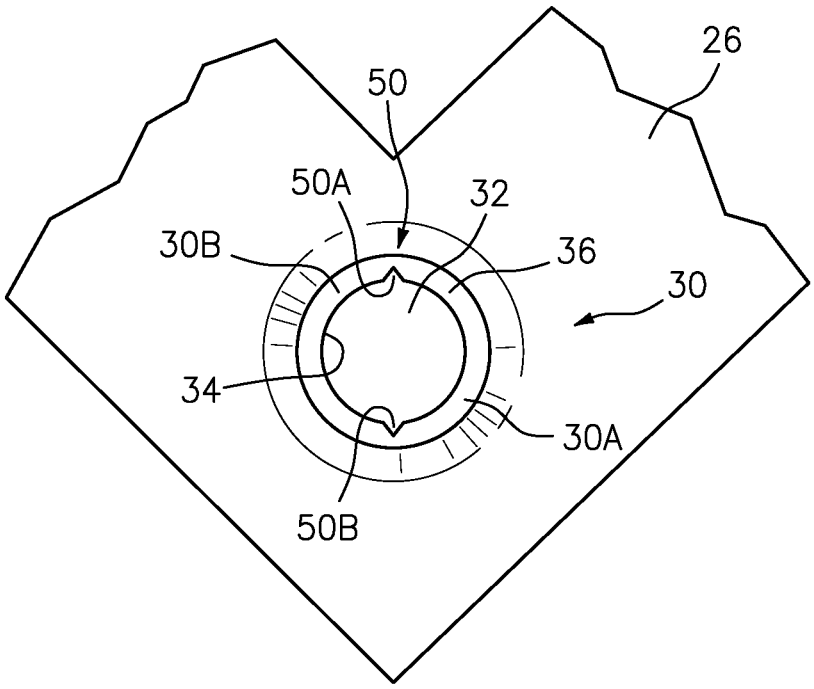
FIG. 8 is a planar view of an embodiment of a fastener aperture portion of a corner flange embodiment.
Figure 9:
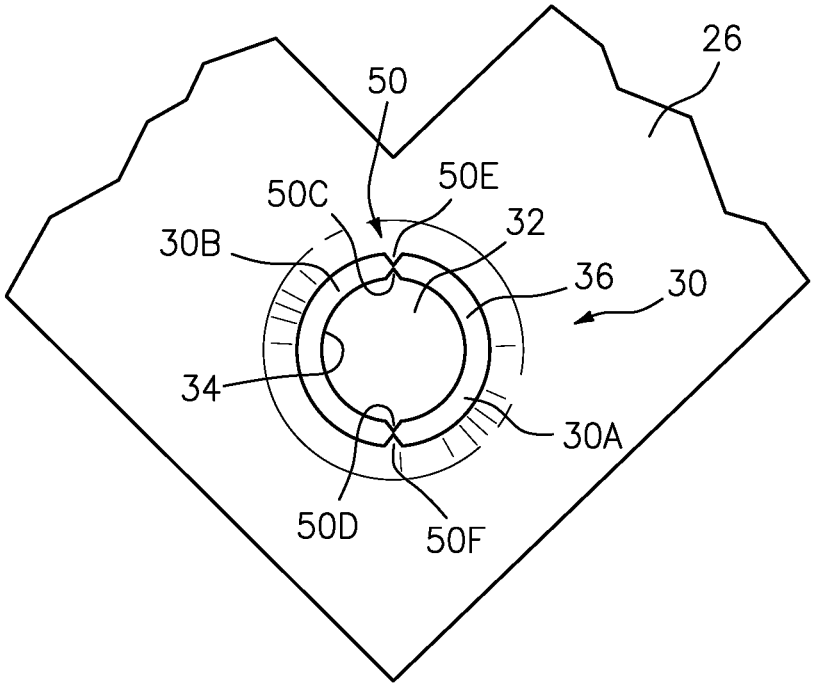
FIG. 9 is a planar view of an embodiment of a fastener aperture portion of a corner flange embodiment.

In the embodiment shown in FIGS. 8 and 9, a truncated cone 30 is formed to include at least one wall failure element 50 (e.g., a reduced thickness wall portion). The wall failure element 50 is configured such that when a bolt is threaded into the truncated cone 30 (as will be described below), the truncated cone 30 will fail (e.g., mechanically shear), at or near the wall failure element 50 and the truncated cone 30 will thereafter be circumferentially discontinuous. FIG. 8 illustrates an embodiment wherein a pair of wall failure elements 50A, 50B are disposed in the inner diameter surface 34 of the truncated cone 30, diametrically opposite one another. FIG. 9 illustrates an embodiment wherein a first pair of wall failure elements 50C, 50D are disposed in the inner diameter surface 34 of the truncated cone 30 and a second pair of wall failure elements 50E, 50F are disposed in the outer diameter surface of the truncated cone 30. Each first wall failure element 50C, 50D may be aligned with a second wall failure element 50E, 50F to produce a reduced thickness wall portion there between. When a bolt is threaded into the truncated cone 30 (as will be described below), the truncated cone 30 will fail at the wall failure element positions and the truncated cone 30 will thereafter include a first cone section 30A and a second cone section 30B. In some embodiments, a wall failure element 50 may be configured such that when a bolt is threaded into the truncated cone 30, the truncated cone 30 will elongate at or near the wall failure element 50 rather than fail.

Figure 10:
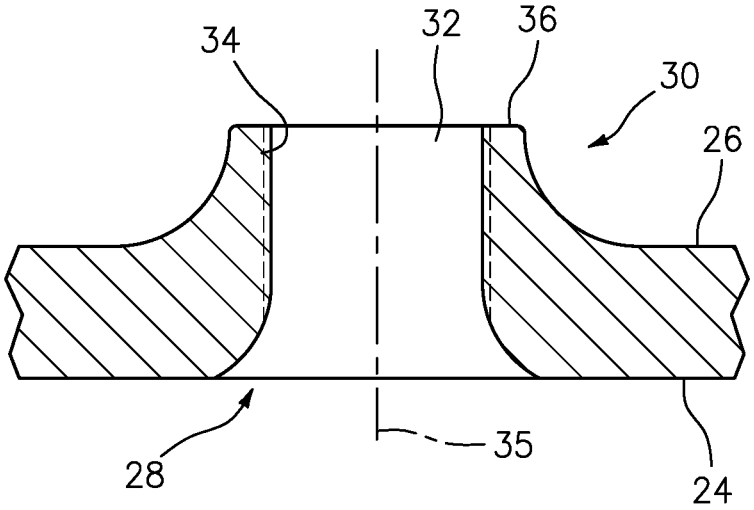
FIG. 10 is a sectional view of a fastener aperture portion of the corner flange embodiment.

In any of the truncated cone embodiments disclosed herein, at least a portion of the bore 32 of the truncated cone 30 may be threaded to facilitate threaded engagement with a fastener. FIG. 10 diagrammatically illustrates a truncated cone 30 having a bore 32 portion that is threaded; e.g., threads 33.

Figure 12:
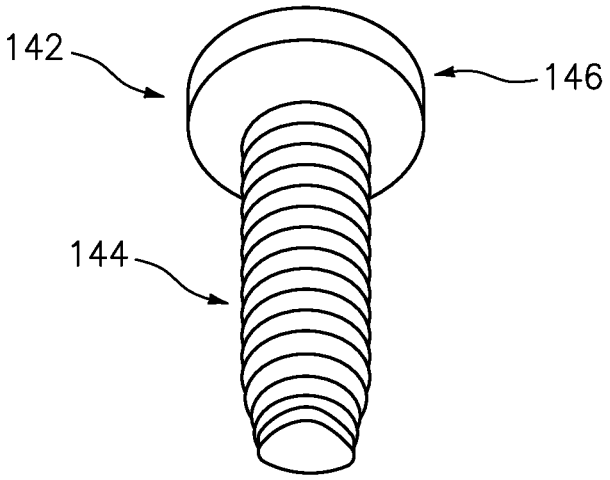
FIG. 12 is a perspective view of a bolt embodiment.
Figure 12A:
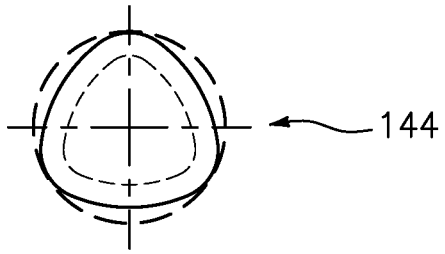
FIG. 12A is a diagrammatic cross-sectional view of the shank portion of the bolt embodiment shown in FIG. 12.

In some embodiments (e.g., see FIG. 11), a self-threading bolt 42 is used that includes a shank 44 and a head 46. A portion of the shank 44 is threaded with a self-threading type of thread. Between the threaded portion of the shank 44 and the head 46, the shank 44 includes an unthreaded section 48. The unthreaded section 48 is configured to not engage with threads cut into the truncated cone 30. The axial length of the unthreaded section 48 may be equal to or greater than the axial length of the threaded portion of the truncated cone (the "threaded portion" may be threaded as a result of engagement with the self-threading portion of the shank). As a result, once the unthreaded section 48 is received completely within the threaded portion of the truncated cone 30, the bolt 42 is non-engaged with that truncated cone and is free to rotate without thread engagement. In some embodiments, the unthreaded section 48 may have a reduced diameter. In these embodiments, once the unthreaded portion is disposed within the truncated cone 30, the bolt 42 is captured by the flange 18 and cannot be separated; i.e., will not fall out of the truncated cone 30, thereby greatly facilitating assembly of the duct work. In addition, the unthreaded portion 48 provides clearance so that the axis of the bolt 42 can be misaligned (e.g., canted) with the axial axis of the truncated cone 30. As a result, small misalignments between the truncated cones of flange pairs can be accommodated during assembly. In some embodiments, the length of the unthreaded section 48 of the shank 44 may be great enough such that the threaded portion will pass through the respective truncated cone 30 of both corner flanges 18 during assembly. In these embodiments, the unthreaded section 48 will be disposed in the truncated cones 30 of both corner flanges after assembly, and the threaded portion (now disposed outside the second corner flange 18) will operate to prevent the corner flanges 18 from being separated from one another. The present disclosure is not limited to any particular type of bolt. The bolt 42 shown in FIG. 11 is circularly configured for a least a portion of the shank. Another example of a bolt that may be used with the present disclosure is a bolt 142 having a tri-lobular shank 144 (sometimes referred to a as a "tri-round" shank) and a head 146 as shown in FIGS. 12 and 12A. The present disclosure is not limited to any particular bolt configuration; self-threading, threaded, cylindrical shank, tri-lobular shank, etc. In addition, the present disclosure is not limited to any particular bolt head configuration; e.g., the head of the bolt 42 may be configured for driving by any conventional driver such as a hex-head driver, a double spline driver, a Torx driver, etc.

Figure 13:
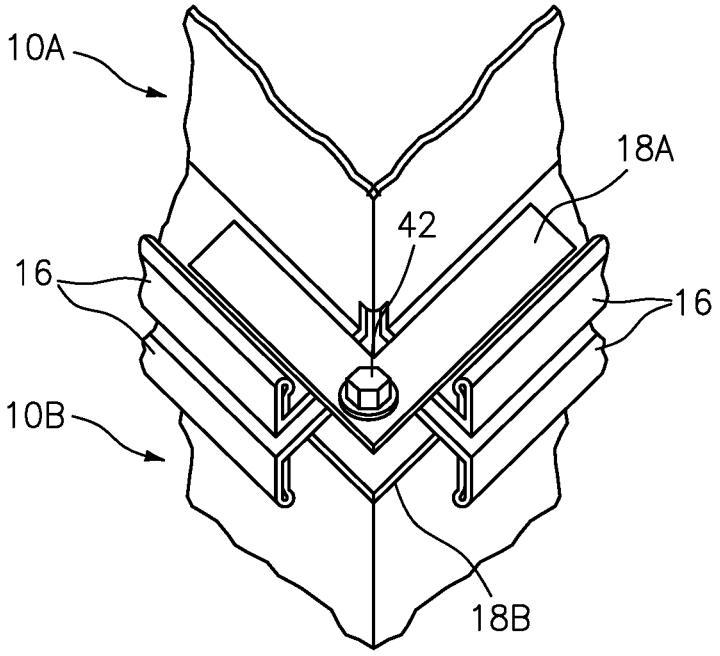
FIG. 13 is a diagrammatic perspective view of duct sections connected by present disclosure corner flange embodiments.

Referring to FIGS. 11 and 13, in the assembly of a pair of duct sections 10A, 10B, in each corner of the duct sections 10A, 10B a pair of corner flanges 18A, 18B are utilized to attach the duct sections 10A, 10B to one another. Each corner flange 18A, 18B is disposed at a corner of the duct sections and the flanges 18A, 18B are attached to one other with the respective duct section end flanges 16 captured there between to strengthen the connection between the duct sections 10A, 10B. FIG. 13 shows a diagrammatic example of a first corner flange 18A attached to a second corner flange 18B by a self-threading bolt 42, thereby attaching the first duct section 10A to a second duct section 10B. FIG. 11 diagrammatically shows a sectional view of the first and second corner flanges 18A, 18B shown in FIG. 13. As can be seen in FIG. 11, the self-threading bolt 42 is threaded through the truncated cone 30 of the first corner flange 18A, and then engages the truncated cone bore 32 of the second corner flange 18B. As the self-threading bolt 42 engages the truncated cone 30 of the second corner flange 18B, the unthreaded section 48 of the bolt shank 44 is received within the truncated cone 30 of the first corner flange 18A. Tightening the self-threading bolt 42 consequently draws the first and second corner flanges 18A, 18B together, thereby securing the first and second duct sections 10A, 10B together.

In those instances wherein a corner flange 18 having a truncated cone 30 with cone sections 30A, 30B and slits 40 is used, the self-threading bolt 42 is threaded through the truncated cone 30 of the first corner flange 18A, and then engages the truncated cone bore 32 of the second corner flange 18B. As the self-threading bolt 42 engages the truncated cone 30 of the second corner flange 18B, the cone sections 30A, 30B will elastically bend radially outward to some degree. The self-threading bolt 42 engages with each cone section 30A, 30B in a manner similar to when the truncated cone 30 does not include slits 40. In the embodiment that utilizes cone sections 30A, 30B, however, the force required to engage the cone sections 30A, 30B may be decreased relative to a truncated cone 30 without slits 40, and the biasing force of the cone sections 30A, 30B promotes continued engagement between the cone sections 30A, 30B and the self-threading bolt 42. Here again, once the bolt 42 is sufficiently engaged with the truncated cone 30 of the first corner flange 18A, the unthreaded section 48 of the bolt shank 44 is received within the truncated cone 30 of the first corner flange 18A. Tightening the self-threading bolt 42 consequently draws the first and second corner flanges 18A, 18B together, thereby securing the first and second duct sections 10A, 10B together.

In those instances wherein a corner flange 18 having a truncated cone 30 with wall failure elements 50 is used, the self-threading bolt 42 is threaded through the truncated cone 30 of the first corner flange 18A, and then engages the truncated cone bore 32 of the second corner flange 18B. When a sufficient amount of the self-threading bolt 42 is engaged with the truncated cone 30 of the second corner flange 18B, the wall failure elements 50 will fail (e.g., shear or plastically elongate) and the cone sections 30A, 30B will elastically bend radially outward to some degree. The self-threading bolt 42 engages with each cone section 30A, 30B in a manner similar to when the truncated cone 30 does not include the wall failure elements 50. The force required to engage the cone sections 30A, 30B may be decreased relative to a truncated cone 30 without wall failure elements 50, and the biasing force of the cone sections 30A, 30B promotes continued engagement between the cone sections 30A, 30B and the self-threading bolt 42. Here again, once the bolt 42 is sufficiently engaged with the truncated cone 30 of the first corner flange 18A, the unthreaded section 48 of the bolt shank 44 is received within the truncated cone 30 of the first corner flange 18A. Tightening the self-threading bolt 42 consequently draws the first and second corner flanges 18A, 18B together, thereby securing the first and second duct sections 10A, 10B together.

Although the invention has been described and illustrated with respect to exemplary embodiments thereof, the foregoing and various other additions and omissions may be made therein and thereto without departing from the spirit and scope of the present invention. For example, the exemplary embodiments described above illustrate a corner flange with a single aperture with a truncated cone located at the intersection between the legs of the corner flange. In alternative embodiments, a corner flange may include a plurality of apertures with truncated cones, and/or one or more apertures with truncated cones located at positions other than the intersection between the legs of the corner flange.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method of joining together duct sections of an HVAC duct, each duct section including a plurality of end flanges, comprising:

providing a first corner flange and a second corner flange, the first corner flange comprising:

a first leg and a second leg, the first and second legs integrally connected to one another at a respective first end, and each leg extending outwardly away from the respective first end away from the other leg;

an interior surface extending along the first and second legs;

an exterior surface extending along the first and second legs, the exterior surface disposed opposite the interior surface;

at least one fastener aperture extending between the interior surface and the exterior surface, the fastener aperture including an integrally formed truncated cone extending out from the exterior surface, wherein the truncated cone has an inner diameter; and providing at least one self-threading bolt having a shank and a head, the shank having a threaded section with a thread diameter sized to engage the inner diameter of the truncated cone;

disposing the first corner flange in contact with a first pair of end flanges of a first duct section;

disposing the second corner flange in contact with a second pair of end flanges of a second duct section; and joining the first and second duct sections together, the joining including passing a one of the at least one self-threading bolt through an aperture in the second corner flange, and threadably engaging the one of the at least one self-threading bolt with the truncated cone of the first corner flange until the first pair of end flanges and the second pair of end flanges are in contact with one another;

wherein the second corner flange is configured the same as the first corner flange; and wherein the shank of the at least one self-threading bolt includes an unthreaded section having a second diameter, the second diameter is less than the thread diameter, the unthreaded section disposed between the threaded section and the head, the thread diameter sized so that the threaded section threadably engages the inner diameter of the truncated cone of the first corner flange during the joining step; and wherein the at least one self-threading bolt is threadably engaged with the truncated cone of the first corner flange until the unthreaded section is disposed within the truncated cone of the second corner flange.

* * * * *